US005351753A

United States Patent [19]

Golson

[11] Patent Number: 5,351,753

[45] Date of Patent: Oct. 4, 1994

[54] LEAK CONTAINMENT SYSTEM FOR A STUFFING BOX

[76] Inventor: Tony Golson, 3709 Irvin Dr., Midland, Tex. 79705

[21] Appl. No.: 11,969

[22] Filed: Feb. 1, 1993

[51] Int. Cl.[5] ..... E21B 33/08

[52] U.S. Cl. ..... 166/81; 166/84; 166/107

[58] Field of Search ..... 166/81, 107, 84, 68.5

[56] References Cited

U.S. PATENT DOCUMENTS

| | | | |
|---|---|---|---|
| 113,638 | 4/1871 | Dewey | 166/81 |
| 1,910,045 | 5/1933 | Paryzek | 166/81 |
| 3,186,722 | 6/1965 | Johnston | 166/84 |
| 3,270,810 | 9/1966 | Johnston | 166/84 |
| 3,532,163 | 10/1970 | Ecuer | 166/84 |
| 4,530,397 | 7/1985 | Calhoun | 166/81 X |
| 4,665,976 | 5/1987 | Retherford | 166/81 |
| 5,150,751 | 9/1992 | Burton et al. | 166/84 X |
| 5,246,067 | 9/1993 | Heinonen et al. | 166/81 |

*Primary Examiner*—Ramon S. Britts

*Assistant Examiner*—Frank S. Tsay

*Attorney, Agent, or Firm*—Ross, Howison, Clapp & Korn

[57] ABSTRACT

A containment device is provided that includes a bottom tray (20) that is of cylindrical shape having a lower surface and one open end. The lower surface has a hole (26) disposed therethrough which is operable to be disposed about a flange on a wellhead with a seal (32) formed between the outer peripheral edges of the hole (26) and the peripheral edge (14) of the flange (12) on the wellhead. The stuffing box (16) will have leaks therefrom collected in the bottom of the tray (20). A cowling (20) is disposed about the stuffing box (16) and supported on a shelf (36) to maintain an amount of any fluid in the bottom of the tray (20). Cap (22) is disposed over the cowling with a hole (38) disposed in the upper surface thereof to allow the polish rod (18) to extend therethrough. An orifice (42) is operable to allow fluid to escape from the tray (20). Each of the bottom tray (20), cowling (24) and the cap (24) are split to allow assembly over and around the wellhead.

8 Claims, 3 Drawing Sheets

LEAK CONTAINMENT SYSTEM FOR A STUFFING BOX

TECHNICAL FIELD OF THE INVENTION

The present invention in general pertains to a stuffing box that surrounds a polish rod on an oil well, and more particularly, to a leak containment system that captures oil leaking and blowing past the stuffing box packing gland.

BACKGROUND OF THE INVENTION

In oil drilling systems, production well heads for a well typically have a stuffing box associated therewith. The stuffing box is disposed around the polish rod and allows the polish rod to reciprocate therethrough when the well is producing fluid. The polish rod is typically located within a pressurized liquid chamber and partially within the ambient. The stuffing box provides a liquid seal between the rod and the pressurized liquid chamber and it may also provide lubrication for the rod through either separate lubrication glands or by utilizing the crude oil that is being pumped as lubricating fluid. The packing gland assembly typically includes deformable disks with pressure applied thereto to cause deformation thereof. This produces a liquid fight seal about the rod between the ambient and the pressurized liquid chamber.

The stuffing boxes that exist today have a tendency to occasionally leak. When this leak occurs, it is sometimes referred to as a minor "blowout". Since most wellheads are located in remote areas, this only presents a problem due to the contamination of the soil disposed about the wellhead. In the present day of increasing environmental concerns, this is a significant detraction to pumping oil out of the ground. When this oil leaks or spills onto the ground, it is necessary to remove the earth that is contaminated and place new earth around the wellhead. However, if the stuffing box continues to leak, this must be repeated at great expense.

SUMMARY OF THE INVENTION

The present invention disclosed and claimed herein comprises a leak containment device for a wellhead stuffing box having a flange with an outer peripheral edge with a first diameter, and a reciprocating polish rod that reciprocates in the stuffing box through an opening above the flange. The containment device includes a bottom tray, a cowling and a cap. The bottom tray is formed of a flexible cylindrical member having an outer circumferential surface and a bottom surface with an open end, the open end being disposed on the upper portion thereof. The bottom surface has a hole disposed therein that has a diameter larger than the flange to allow the hole to be disposed about the outer peripheral edge of the flange. A split is formed in the bottom surface of the bottom tray and extending outward from one edge thereof to the circumferential surface and therealong to allow the flexible bottom tray to be separated and disposed around the flange. A first clamp is operable to secure the split edges of the outer circumferential surface together. A seal is disposed between the hole in the bottom surface of the tray and the flange, and also extends along the portion of the bottom surface that is split and the portion of the outer circumference that is split. The cowling is comprised of a cylindrical member having an outer diameter that is slightly larger than the inner diameter of the bottom tray and a split formed in one side thereof extending parallel to the longitudinal axis thereof. The cowling is fabricated of a flexible material that can be separated at the split to encircle the wellhead. A clamp is operable to clamp the split edges together to secure the cowling and then the cowling inserted in the upper end of a bottom tray. The cap is constructed similar to the bottom tray with a hole disposed in the upper surface and the bottom surface thereof being open. The inner diameter of the cap is slightly smaller than the outer diameter of the cowling and is operable to be disposed over the upper end of the cowling. A hole is disposed in the upper surface of the cap to allow the reciprocating polish rod to extend therethrough.

In another aspect of the present invention, a shelf is provided on the interior surface of the outer circumferential surface of the outer tray to receive the lower circumferential surface of the cowling. When constructed, a long strip of foam having one side thereof with an adhesive material formed thereon is wrapped about the peripheral edge of the flange, with the length of the strip being significantly longer than the circumference of the flange. The extra portion of the foam strip is operable to be disposed between the abutting edges of the split in the bottom tray such that a seal is formed therein.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
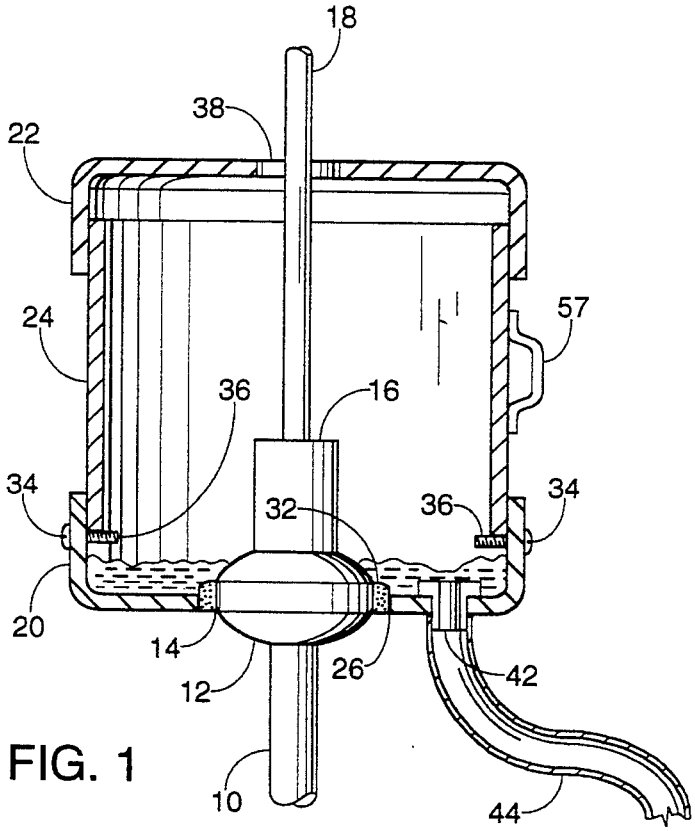
FIG. 1 illustrates a cross-sectioned diagram of the leak containment system of the present invention.

Referring now to FIG. 1, there is illustrated a cross-sectional view of the leak containment system of the present invention. A wellhead is provided which has a vertical pump string 10 interfaced with a flange 12 having an outer peripheral edge 14. The pump string 10 and flange 12 form a portion of the wellhead. The upper portion of the wellhead has associated therewith a stuffing box 16 and a polish rod 18, the polish rod 18 reciprocating through the stuffing box 16. Although not shown, the stuffing box 16 is a conventional stuffing box that has disposed therein a packing gland. The packing gland is disposed in the stuffing box 16 and is a deformable member surrounding the polish rod 18 and providing a liquid seal therewith to prevent pressurized fluid below the packing gland from exiting around the sliding fit between the stuffing box 16 and the polish rod 18. In the preferred embodiment, the stuffing box 16 is of the type manufactured by Huber.

The leak containment system is comprised of a bottom tray 20, an upper cap 22 and a cowling 24. The bottom tray 20 has a hole 26 disposed in the lower surface thereof and slightly larger than the outer peripheral edge 14 of the flange 12. A sealing layer of foam 32 is disposed between the peripheral edges of the hole 26 and the peripheral edge of the flange 12. The lower tray 20 has an outer circumferential surface substantially parallel to the longitudinal axis of the polish rod 18, which circumferential edge extends upward from the bottom surface of the bottom tray 20. The cowling 24 has an outer diameter that is slightly larger than the inner diameter of the outer circumferential edge of the bottom tray 20, such that it can be disposed therein to provide a tight fit. Screws 34 are disposed through the outer circumferential surface of the bottom tray 20 to extend inward thereto and substantially parallel to the bottom surface of the bottom tray 20 and disposed upward therefrom a predetermined distance. The screws 34 therefore provide a shelf 36 on which the bottom peripheral edge of the cowling 24 can rest. The shelf 36 prevents the bottom peripheral edge of the cowling 24 from extending all the way to the bottom surface of the bottom tray 20. It can be seen that fluid will accumulate in the bottom of the bottom tray 20 and it is desirable to prevent the bottom peripheral edges of the cowling 24 from contacting this fluid, as this maintains a bottom surface that is relatively clean compared to the bottom surface of the bottom tray 20.

The cap 22 is shaped similar to the bottom tray 20 in that it has an outer circumferential edge that has an inner diameter slightly less than the outer diameter of the cowling 24 to provide a snug fit therefor. A hole 38 is disposed in the upper surface of the cap 22 to allow the polish rod 18 to reciprocate therethrough. The hole 38 can be substantially equal to the outer diameter of the polish rod 18, allowing for tolerances during the reciprocation thereof. The locations in which wellheads are typically located have relatively little rainfall. Therefore, the hole 38 allows any rain that would enter the interior of the containment device to evaporate. Further, the hole 38 also prevents gas from accumulating into the interior of the containment device. An orifice 42 is disposed through the bottom of the bottom tray 20 to allow fluid to drain therefrom. The orifice 42 is interfaced with a drain tube 44.

Figure 2:
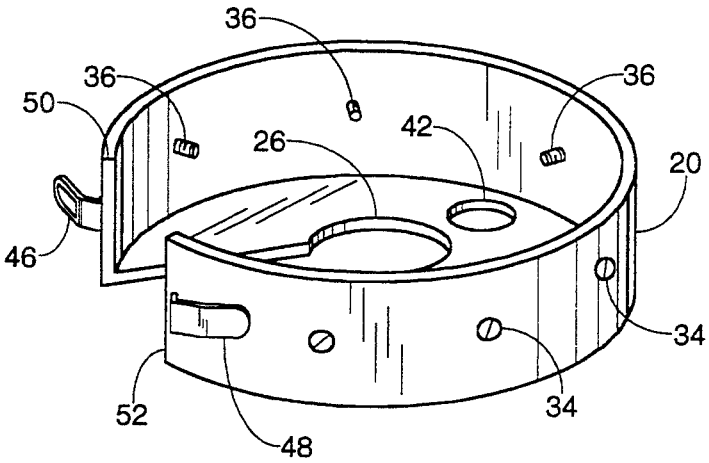
FIG. 2 illustrates a perspective view of the bottom tray of the leak containment system.
Figure 2A:
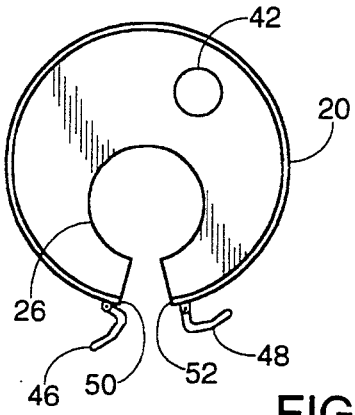
FIG. 2*a* illustrates a top view of the bottom tray.

Referring now to FIG. 2, there is illustrated a perspective view of the bottom tray 20. The bottom tray 20 is manufactured from a polyvinyl chloride (PVC) material which is flexible. It is initially fabricated as a circumferential member with one closed end with the hole 26 disposed through the closed end. Thereafter, the outer circumferential edge and bottom surface from the edge into the hole 36 is "split" to allow the circumferential outer surface of the bottom tray 22 to be widened and allow the outer peripheral edge of the outer flange 12 to be disposed within the hole 26 such that the bottom tray 20 can completely encircle the outer peripheral edge 14 of the flange 12 and interface with the seal 32. A trunk latch comprised of two portions 46 and 48 is disposed on or proximate to an end 50 and an end 52, respectively, of the outer circumferential edge of the bottom tray 20 at the split therein. A top view of this is illustrated in FIG. 2*a*, also illustrating that the hole 26 is disposed off center with respect to the center of the bottom tray 20, this allowing more area for the orifice 22 to be disposed in.

Figure 3A:
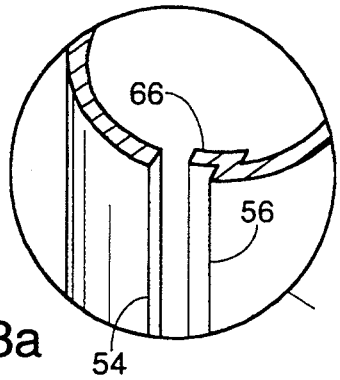
FIGS. 3 and 3*a* illustrate an exploded view of the bottom tray, upper cap and cowling.
Figure 3:
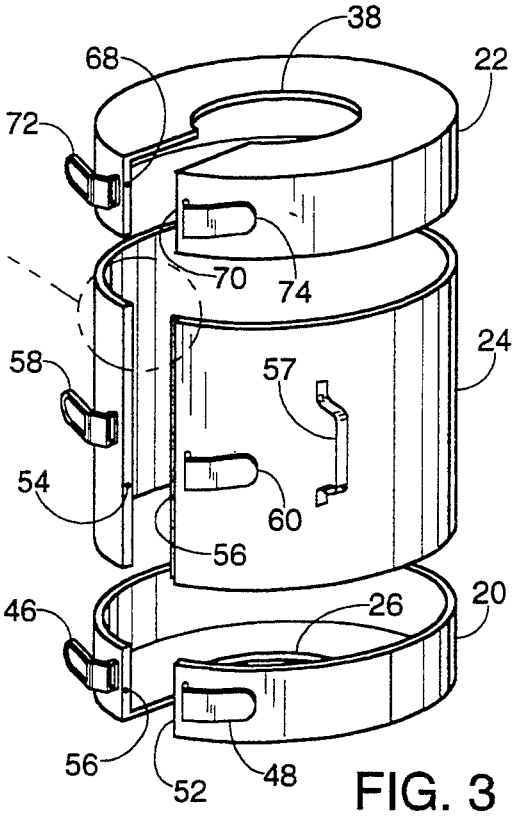

Referring now to FIG. 3, there is illustrated an exploded view of the leak containment system of the present invention. The cowling 24 is formed of a sheet of PVC that is wrapped in a circumferential manner, the sheet having an end 54 and an end 56. The ends 54 and 56 abut to form a cylinder that has an outer diameter slightly larger than the inner diameter of the bottom troy 20. A trunk latch is also provided on the cowling 24 comprised of first and second pans 58 and 60, similar to the trunk latch parts 46 and 48 associated with the bottom tray 20. Handles 57 are provided on the surface of the cowling 24. Additionally, as illustrated in the detail of FIG. 3*a*, the end 56 has a flange 66 associated therewith, which flange 66 is operable to provide a seal on the interior side of the cowling 24 when the ends 54 and 56 abut. This prevents fluid from leaking out of the seam in the event that the containment device fills up due to either the orifice 42 being sealed or the reservoir to which it is connected being full.

The cap 22 is fabricated from a cylindrical piece of PVC material having one closed end, similar to the lower tray 20. The hole 38 is formed therein and then a "split" formed from one edge of the hole 38 extending out to a circumferential edge of the cap 22 and along the circumferential surface thereof to form an end 68 and an end 70 that are operable to abut. This allows the cap 22 to operate similar to the bottom tray 20 in that the ends 68 and 70 can be separated to allow the cap 22 to go around the polish rod 18. A trunk latch comprised of portions 72 and 74 is disposed proximate to the ends 68 and 70, respectively. When the device is assembled, the bottom tray 20 is first disposed about the peripheral edge 14 of the flange 12 and secured thereto. The cowling 24 is then disposed about the wellhead and the polish rod 18 and secured thereto, followed by assembly of the cap 22.

Figure 4A:
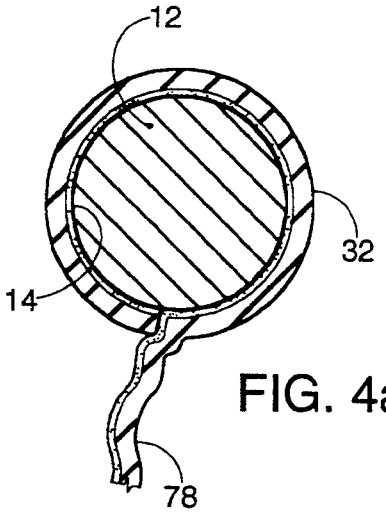
FIG. 4*a* illustrates the first step in forming the seal about the lower flange on the stuffing box.

Referring now to FIG. 4*a*, there is illustrated a detail of the method for disposing the seal 32 about the peripheral edge 14 of the flange 12, this being an important aspect of the present invention. Initially, the peripheral edge 14 is cleaned and a foam strip having one side thereof with an adhesive material formed thereon. The strip is disposed around the peripheral 14 of the flange 12, with the strip being longer than necessary to cover the circumference of the peripheral edge 14, this resulting in an extending piece 78.

Figure 4B:
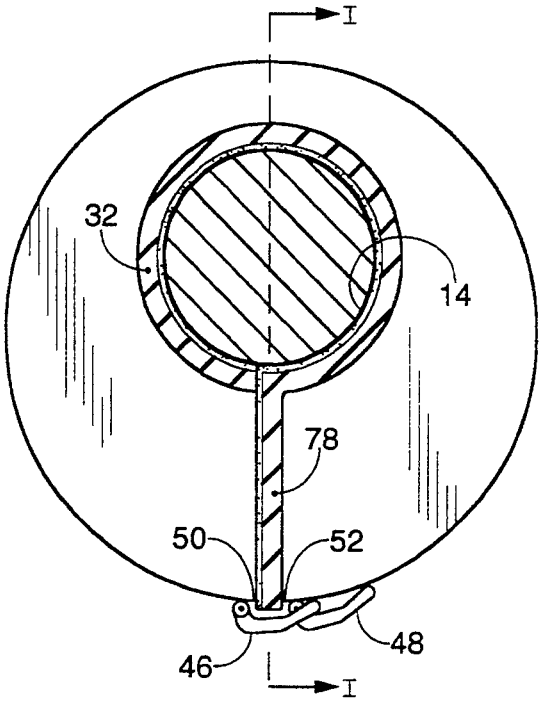
FIG. 4*b* illustrates the top view of the tray and the interface with the field.
Figure 4C:
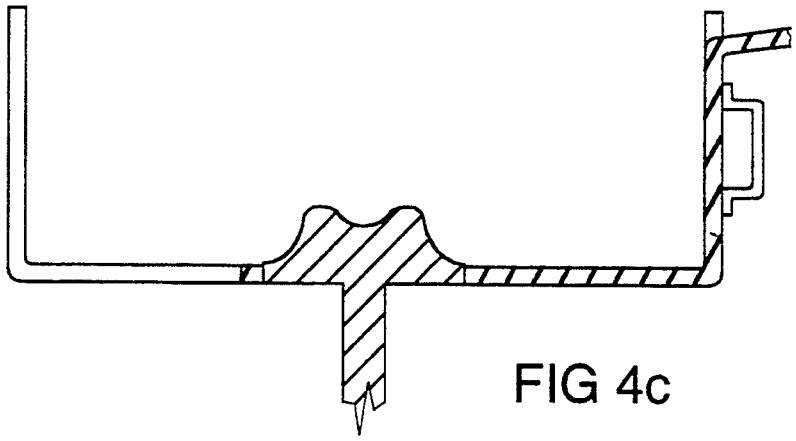
FIG. 4*c* illustrates a cross-sectional view illustrating the interface of the seal with the lower tray.

The extending piece 78 is operable to be disposed along the "split" in the bottom tray 20 and to provide a seal therefor and upwards between the abutting ends 50 and 52, as illustrated in FIG. 4*b*. Thereafter, the bottom tray can be disposed about the seal 32 and the two abutting ends 50 and 52 disposed about the extending piece 78 of the adhesive strip. The adhesive strip extends along the bottom surface between the abutting ends of the bottom tray 20 and upward along the abutting ends 50 and 52 to provide a complete seal therefor. A cross-sectional view of the resultant structure is illustrated in FIG. 4*b*.

Figure 5:
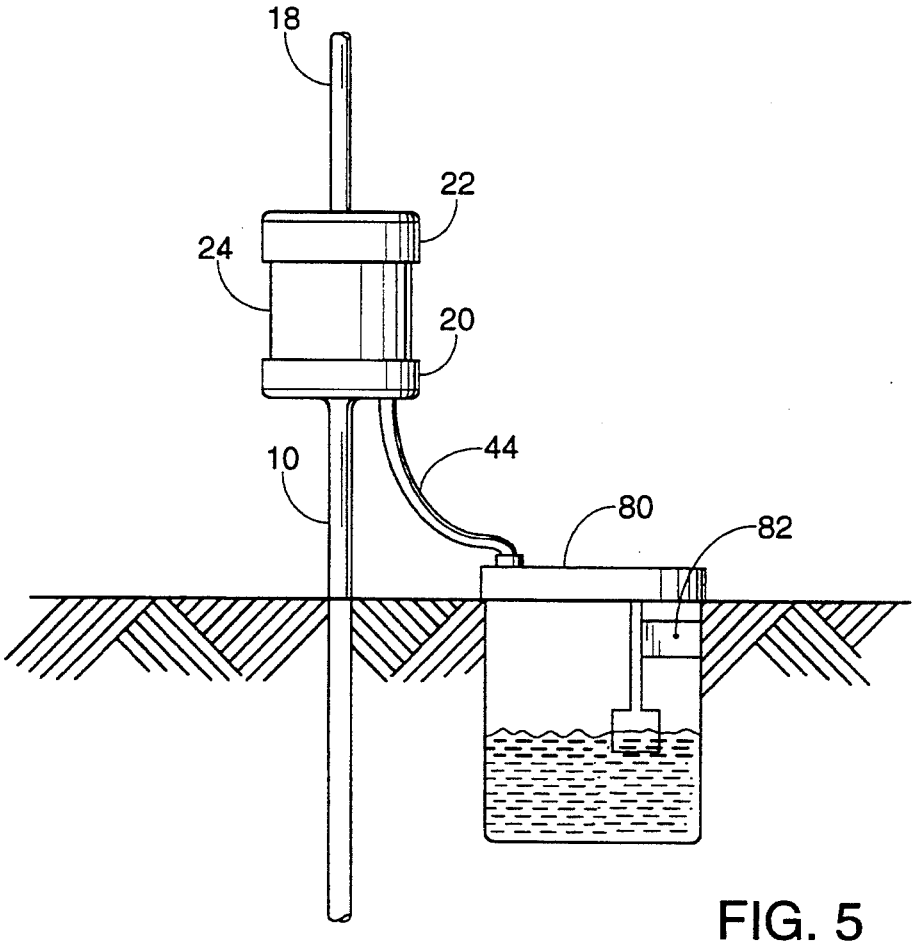
FIG. 5 illustrates one embodiment of an external reservoir for interfacing with the bottom tray of the leak containment system.

Referring now to FIG. 5, there is illustrated a side view of the assembled containment device and a reservoir 80. The reservoir 80 can be a large drum that is buried in the ground or one that is above ground. The drainage tube 44 is connected to the reservoir 80 to allow fluid to drain therein. An overfill detector 82 is provided in the reservoir 80 to indicate when the reservoir 80 is full. This information can be transferred to a remote location or merely indicated mechanically at the reservoir.

In summary, there has been provided a leak containment device for being disposed about the stuffing box in a wellhead. The leak containment device includes three members, a bottom tray, a cowling and a cap member. The bottom tray is operable to be formed of a cylindrical device having a bottom surface and a hole disposed in the middle of the bottom surface. A split is formed from the hole outward to the outer circumferential edge to allow the tray to be opened to encircle the lower portion of the wellhead about the stuffing box. A seal is disposed about the peripheral edge of the stuffing box and the wellhead flange and the bottom tray disposed thereabout, the seal being formed from a strip of foam material that extends along the split to form a complete seal with the secured bottom tray. Thereafter, a cylindrical cowling is disposed in the tray extending upward therefrom and surrounding the stuffing box, and then a cap disposed on the upper end thereof with a hole disposed therein to allow the polish rod to extend therein.

Although the preferred embodiment has been described in detail, it should be understood that various changes, substitutions and alterations can be made therein without departing from the spirit and scope of the invention as defined by the appended claims.

What is claimed is:

1. A leak containment device for a wellhead stuffing box having a flange with an outer peripheral edge with a first diameter and a reciprocating polish rod reciprocated in the stuffing box through an opening therein above the flange, comprising:

a partially split single piece bottom tray having a cylindrical shape with an outer circumferential surface with a first inner diameter and a bottom surface over one end of said cylindrical shape, said circumferential surface extending upward from said bottom surface, said bottom surface having a hole with a second inner diameter larger than the first diameter of the flange, said bottom surface and said circumferential surface having a partial split that extends from one point on the edge of said hole outward along said bottom surface to said circumferential surface and upward away from said bottom surface along said circumferential surface to form first and second abutting and separable edges, said bottom tray fabricated from a flexible material to allow said abutting edges to be separated to encircle the flange so as to facilitate easy installation without the need to disassemble the wellhead or the stuffing box;

a first clamp disposed proximate to a portion of said first and second abutting edges on said circumferential surface to allow said first and second abutting edges to be forced together, so as to bring said second inner diameter into contact with said flange to hold said bottom tray in position relative to said stuffing box;

a continuous layer of sealing material disposed on the outer surface of the flange on said bottom surface and wrapped therearound and extending proximate to both of said first and second abutting edges are abutting and secured with said first clamp, said sealing material forms a seal between said first and second abutting edges;

a cowling having a cylindrical shape with open ends and a split that extends parallel to the longitudinal axis of said cowling to form third and fourth abutting edges such that when said third and fourth abutting edges abut, said cowling has an outer diameter that is slightly smaller than said first inner diameter of said bottom tray, said cowling being fabricated from flexible material and operable to have said third and fourth abutting edges separated to allow said cowling to be disposed abut the stuffing box such that when said third and fourth abutting edges are abutted, said cowling can be tightly inserted into the bottom tray from the open end thereof;

a second clamp having first and second portions for being disposed proximate to each of said third and fourth abutting edges, respectively; said first and second portions operable to mate and secure said third and fourth abutting edges in an abutting relationship;

a top having a cylindrical shape with an outer circumferential surface with a third inner diameter substantially identical to said first inner diameter and an upper surface over one end of said circumferential surface, said outer circumferential surface extending downward from said upper surface, said upper surface having a hole disposed therein with a predetermined diameter, said upper surface and said circumferential surface having a split that extends from one point on the edge of said hole outward along said upper surface to said associated circumferential surface and down said associated circumferential surface away from said upper surface to form fifth and sixth abutting edges, said top fabricated from a flexible material to allow said fifth and sixth abutting edges to be separated to allow said top to encircle the polish rod above the stuffing box and within said hole, said predetermined diameter of said hole larger than the diameter of the polish rod; and a third clamp having first and second portions disposed proximate to said fifth and sixth abutting edges and operable to force said fifth and sixth abutting edges into an abutting relationship.

2. The leak containment device of claim 1, wherein said bottom tray, said cowling and said top are fabricated from a flexible polyvinyl chloride material, such that said bottom tray, said cowling and said top are easily installed without the need to disassemble the wellhead or the stuffing box.

3. The leak containment device of claim 1, wherein further comprising a drain orifice disposed in said bottom surface of said bottom tray to allow fluid that is disposed therein to drain outward therefrom.

4. The leak containment device of claim 1, wherein said seal is comprised of a strip of foam material, such that it can expand and contract, having adhesive to the outer surface of the peripheral edge of the flange and having a length that is greater than the circumference of the outer peripheral edge of the flange such that a piece of the strip of foam material extends outward from the flange to form an extension, said extension operable to extend outward along said first and second abutting edges such that it will be disposed and then compressed between said first and second abutting edges when said first and second abutting edges are secured in an abutting relationship when installing said partially split bottom tray.

5. The leak containment device of claim 1, and further comprising a shelf mechanism disposed along the inner surface of said circumferential surface of said bottom tray and disposed substantially parallel with said associated bottom surface and extending inward from said circumferential surface, said shelf device disposed a predetermined distance above said bottom surface of said bottom tray to prevent the lower circumferential edge of said cowling from extending into any fluid in the bottom of said bottom tray.

6. The leak containment device of claim 1, and further comprising handles disposed on the outer surface of said cowling.

7. The leak containment device of claim 1, wherein the said opening in said top is of sufficient size to allow vapor to escape therefrom.

8. The leak containment device of claim 1, wherein said third and fourth abutting edges have a seal associated therewith, said seal comprised of a longitudinal member disposed on the interior side of said third abutting edge and extending longitudinally therealong and extending circumferentially outward therefrom so that when said third and fourth abutting edges are in an abutting relationship, said longitudinal member extends behind the abutting seam between said third and fourth abutting edges.

* * * * *

UNITED STATES PATENT AND TRADEMARK OFFICE

CERTIFICATE OF CORRECTION

PATENT NO. : 5,351,753

DATED : October 4, 1994

INVENTOR(S) : Tony Golson

It is certified that error appears in the above-indentified patent and that said Letters Patent is hereby corrected as shown below:

Column 1, line 26, replace "fight" with --tight--.

Column 4, line 10, replace "troy" with --tray--.

Column 4, line 11, replace "pans" with --parts--.

Column 5, Claim 1, line 62, after "edges" insert --and along the entire surface thereof, such that, when said first and second abutting edges--.

Column 6, Claim 1, line 14, replace ";" with --,--.

Column 6, Claim 4, line 54, after "adhesive" insert --disposed on one side thereof, said strip of adhesive material operable to be adhered--.

Signed and Sealed this

Twenty-eight Day of February, 1995

*Attest:*

Bruce Lehman

BRUCE LEHMAN

*Attesting Officer*

*Commissioner of Patents and Trademarks*